US007942492B2

(12) United States Patent
Sugahara

(10) Patent No.: US 7,942,492 B2
(45) Date of Patent: May 17, 2011

(54) LIQUID TRANSPORTING APPARATUS HAVING TEMPERATURE REGULATION

(75) Inventor: Hiroto Sugahara, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 95 days.

(21) Appl. No.: 12/228,936

(22) Filed: Aug. 18, 2008

(65) Prior Publication Data

US 2009/0051723 A1 Feb. 26, 2009

(30) Foreign Application Priority Data

Aug. 22, 2007 (JP) ..... 2007-215600

(51) Int. Cl.
*B41J 29/38* (2006.01)
*B41J 2/04* (2006.01)

(52) U.S. Cl. ..... 347/17; 347/54

(58) Field of Classification Search ..... 347/17
See application file for complete search history.

(56) References Cited

U.S. PATENT DOCUMENTS

| | | | | |
|---|---|---|---|---|
| 5,191,360 | A * | 3/1993 | Pohlig | 347/17 |
| 5,208,611 | A * | 5/1993 | Kappel et al. | 347/17 |
| 6,648,443 | B1 * | 11/2003 | Rausch et al. | 347/17 |
| 2001/0048017 | A1 * | 12/2001 | Farnworth | 228/33 |
| 2006/0103695 | A1 * | 5/2006 | Young et al. | 347/58 |
| 2006/0245979 | A9 | 11/2006 | Sugahara | |

FOREIGN PATENT DOCUMENTS

| | | |
|---|---|---|
| JP | 2002-162506 | 6/2002 |
| JP | 2006-35640 | 2/2006 |

* cited by examiner

*Primary Examiner* — Matthew Luu
*Assistant Examiner* — Shelby Fidler
(74) *Attorney, Agent, or Firm* — Frommer Lawrence & Haug LLP

(57) ABSTRACT

An ink transporting head includes a head main body in which, an ink channel is formed, a transporting electrode which is arranged on an inner surface of the ink channel, an insulating layer which is arranged on the inner surface of the ink channel to cover the transporting electrode, and which changes a wetting angle of liquid on a surface according to an electric potential of the transporting electrode, and a heat generator which heats the ink inside the ink channel. Accordingly, there is provided a liquid transporting apparatus which is capable of suppressing a temperature fluctuation of the liquid inside the liquid channel, and transporting the liquid stably.

13 Claims, 13 Drawing Sheets

LIQUID TRANSPORTING APPARATUS HAVING TEMPERATURE REGULATION

CROSS-REFERENCE TO RELATED APPLICATION

The present application claims priority from Japanese Patent Application No. 2007-215600, filed on Aug. 22, 2007, the disclosure of which is incorporated herein by reference in its entirety.

BACKGROUND OF THE INVENTION

1. Field of the Invention

The present invention relates to a liquid transporting apparatus which transports an electroconductive liquid.

2. Description of the Related Art

A printer in which an ink-jet recording head is installed has hitherto been known as a printer which records an image and the like on a recording medium such as a recording paper. In the ink-jet recording head, a pressure is applied to the ink inside an ink channel to transport the ink to a nozzle, and further, the ink is jetted from the nozzle toward the recording medium. However, in the ink-jet recording head, a channel structure and a structure of an actuator for generating a transporting pressure and a jetting pressure for the ink is peculiar and complicated. Therefore, there have been limitations on making the recording head small when a plurality of nozzles are arranged highly densely.

In view of this, the inventor of the present invention has proposed a liquid transporting apparatus which transports an electroconductive liquid by using an electrowetting phenomenon, as an apparatus which has a simple structure than the conventional ink-jet head, and which is capable of transporting a liquid such as an ink (For example, refer to Japanese Patent Application Laid-open No. 2006-35640).

The liquid transporting apparatus described in Japanese Patent Application Laid-open No. 2006-35640 has a substrate in which a plurality of liquid channels is formed, individual electrodes (a first individual electrode and a second individual electrode) each of which is arranged half way in one of the liquid channels, and an insulating layer which covers the individual electrodes. When a driving electric potential is applied to the individual electrode, an electric potential difference between the liquid and the individual electrode is small, and a wetting angle of the liquid with respect to a surface of the insulating layer covering the individual electrode is large. Therefore, the liquid cannot move onto the surface of the insulating layer. In this case, when a driving electric potential is applied to the individual electrode, and when a predetermined potential difference is developed between the individual electrode below the insulating layer, and the liquid on the insulating layer, the wetting angle of the liquid with respect to the surface of the insulating layer becomes small (electrowetting phenomenon). Therefore, the liquid can move onto the surface of the insulating layer covering the individual electrode. According to this structure, it is possible to transport the liquid independently in the plurality of liquid channels only by changing the electric potential of the electrode (the first electrode and the second electrode), without complicating the structure of the liquid channel.

SUMMARY OF THE INVENTION

However, in the abovementioned liquid transporting apparatus, when a temperature of the liquid in the liquid channel fluctuates by a heat imparted from an outside, or a fluctuation in the environmental temperature, a viscosity and a surface tension of the liquid are changed. In this manner, when the viscosity and the surface tension of the liquid are changed, a flow resistance of the liquid in the liquid channel and a degree of decrease in the wetting angle at the surface of the insulating layer when the driving electric potential is applied to the individual electrode are changed. There is a possibility that the transporting of liquid becomes unstable due to the change in the flow resistance and the degree of decrease in the wetting angle.

An object of the present invention is to provide a liquid transporting apparatus which is capable of suppressing a temperature fluctuation of the liquid inside the liquid channel, and transporting the liquid stably.

According to a first aspect of the present invention, there is provided a liquid transporting apparatus which transports an electroconductive liquid, including a channel forming body having a liquid channel through which the liquid flows formed therein;

a transporting electrode arranged on a surface, of the channel forming body, defining the liquid channel;

an insulating layer arranged on the surface of the channel forming body defining the liquid channel to cover the transporting electrode;

a power supply which applies a predetermined electric potential to the transporting electrode; and a temperature regulator which regulates a temperature of the liquid in the liquid channel at a predetermined temperature.

According to the first aspect of the present invention, since the liquid transporting apparatus of the present invention includes the temperature regulator (temperature control mechanism) which controls the temperature of the liquid at the predetermined temperature, it is possible to maintain the temperature of the liquid to be constant (fixed) despite an ambient temperature. Therefore, it is possible to maintain a viscosity and a surface tension of the liquid to be almost constant. Accordingly, it is possible to stabilize a transporting of liquid by an electrowetting. "To control to the predetermined temperature", precisely, means maintaining the temperature to be constant in an acceptable fixed temperature range, in addition to maintaining the temperature at a certain predetermined temperature. Moreover, when an electric potential difference between the transporting electrode and the liquid is less than a predetermined critical electric potential difference, a wetting angle of the insulating layer of the present patent application, with respect to the liquid becomes larger (wider) than a predetermined critical wetting angle. In this case, the liquid cannot move onto the insulating layer. However, when the electric potential difference between the transporting electrode and the liquid is not less than the predetermined critical electric potential difference, the wetting angle of the insulating layer of the present patent application, with respect to the liquid becomes smaller than or equal to the predetermined critical wetting angle. In this case, the liquid can move onto the insulating layer.

In the liquid transporting apparatus of the present invention, the temperature regulator may include a heater which heats the liquid in the liquid channel.

In this case, by heating the liquid inside the liquid channel by the heater (heating mechanism), it is possible to stabilize the temperature of the liquid. Accordingly, it is possible to suppress the viscosity and the surface tension of the liquid, and to stabilize the transporting of the liquid by the electrowetting.

In the liquid transporting apparatus of the present invention, the heater may be a heat generator which releases heat by an electric current. In this case, it is possible to heat the liquid by the heater having a simple structure including the heat generator.

In the liquid transporting apparatus of the present invention, the heat generator may be formed on the surface of the liquid channel on which the transporting electrode is arranged, and the insulating layer which covers the transporting electrode may cover the heat generator. In this case, since the heat generator formed of an electroconductive material is covered by the insulating layer in common with the transporting electrode, it is possible to insulate easily the heat generator from the electroconductive liquid.

In the liquid transporting apparatus of the present invention, the liquid channel may have a common liquid chamber and a plurality of individual channels which are branched from the common liquid chamber, and the transporting electrode may have a plurality of individual transporting electrodes, and each of the individual transporting electrodes may be formed on a surface portion, of the channel forming body, defining one of the individual channels. In this case, by changing an electric potential of each of the transporting electrodes, it is possible to transport the liquid independently in the individual channels which are branched from the common liquid chamber.

In the liquid transporting apparatus of the present invention, the heat generator may be formed commonly for the plurality of individual channels. In this case, it is possible to heat the liquid in the individual channels at a time by supplying the electric power to one heat generator.

In the liquid transporting apparatus of the present invention, the heat generator may be formed on the surface portion of the channel forming body defining each of the individual channels, at a position on an upstream side, of one of the individual transporting electrodes, in a flow direction of the liquid. In this case, in the liquid channel, since the liquid is heated immediately before transporting on the transporting electrode, it is possible to stabilize the transporting of liquid on the surface of the insulating layer covering the electrode.

In the liquid transporting apparatus of the present invention, the heat generator may be formed on the surface portion of the channel forming body, defining each of the individual channels, at a position on a downstream side, of one of the individual transporting electrodes, in the flow direction. In this case, since it is possible to heat the liquid at the upstream side and the downstream side of the transporting electrode, it is possible to stabilize the temperature of the liquid inside the liquid channel. Therefore, it is possible to stabilize the transporting of liquid on the surface of the insulating layer covering the transporting electrode.

In the liquid transporting apparatus of the present invention, the heat generator may be formed on a surface of the channel forming body defining the common liquid chamber. In this case, as the liquid is heated in the common liquid chamber before branching into the plurality of individual channels, unevenness in the liquid temperature in the plurality of individual channels is suppressed.

In the liquid transporting apparatus of the present invention, the electric current may be supplied to the heat generator by the power supply, and the liquid in the liquid channel may be heated by the heat generator.

In this case, it is possible to apply an electric potential to the transporting electrode for transporting the liquid, and supply the electric power to the heat generator for heating the liquid by one power supply.

In the liquid transporting apparatus of the present invention, a plurality of first contact portions connected to the individual transporting electrodes respectively, and a plurality of second contact portions connected to the heat generator may be drawn up to an end portion of the channel forming body.

In this case, since the plurality of first contact portions for applying the electric potential to the transporting electrode and the plurality of second contact portions for supplying the electric power to the heat generator are drawn up to the end portion of the channel forming body, it becomes easy to connect these contact portions and the power supply by using a flexible (circuit) board etc.

In the liquid transporting apparatus of the present invention, a plurality of liquid jetting ports communicating with the plurality of individual channels respectively may be formed at one end portion of the channel forming body, and the first contact portions and the second contact portions may be drawn up to another end portion of the channel forming body, on a side opposite to the liquid jetting ports.

In this case, since the first contact portions and the second contact portions are drawn up to the end portion on the side opposite to the liquid jetting ports communicating with the individual channels respectively, even when the number of individual channels (liquid jetting ports) is large, drawing of the first contact portions and the second contact portions (in other words, drawing of the heat generator and wires connected to the transporting electrodes) becomes easy.

In the liquid transporting apparatus of the present invention, the temperature regulator may include a temperature detecting unit which detects the temperature of the liquid in the liquid channel, and a temperature control unit which controls the heater based on the temperature of the liquid detected by the temperature detecting unit. In this manner, since the temperature control unit controls the heater, based on the temperature detected by the temperature detecting unit, it is possible to stabilize assuredly the temperature of the liquid.

In the liquid transporting apparatus of the present invention, the liquid inside the liquid channel may be a melted solder, and the temperature control unit may control the heater such that a temperature of the solder is not less than a melting temperature of the solder. In this case, since it is possible to maintain the temperature of the solder to the melting temperature or more (higher than the melting temperature), it is possible to prevent the solder from hardening inside the channel.

In the liquid transporting apparatus of the present invention, the heat generator may be arranged on the surface of the channel forming body defining the individual channel, on one side in a width direction orthogonal to the flow direction, and may not be arranged on the surface of the channel forming body defining the individual channel, on the other side in the width direction. In this case, the insulating layer covering the heat generator is arranged only on one side of the individual channel. Therefore, since an area in which the insulating layer is not formed (an area having a liquid repellent property inferior to a liquid repellent property of the insulating layer) is formed on one side of each individual channel, there is no possibility that the transporting of the liquid inside the individual channel is hindered by the insulating layer covering the heat generator.

In the liquid transporting apparatus of the present invention, the temperature regulator may have a heat transfer medium which has a fluidity, and a heat transfer medium temperature control mechanism which controls a temperature of the heat transfer medium, and a heat transfer medium channel through which the heat transfer medium flows may be formed in the channel forming body, and the heat transfer medium in the heat transfer medium channel and the liquid in the liquid channel may be in a thermal contact. In this case, by controlling the temperature of the heat transfer medium to be not more that an environmental temperature, it is possible to maintain the temperature of the liquid to be constant while cooling. This is effective particularly when it is desirable to maintain the temperature of the liquid to be not more than a room temperature.

In the liquid transporting apparatus of the present invention, the temperature regulator may have a circulating mechanism which circulates the heat transfer medium through the heat transfer medium channel. In this case, since the heat transfer medium is circulated through the heat transfer medium channel by the circulating mechanism, it is possible to make small (to decrease) a temperature difference of the heat transfer medium at a position of the heat transfer medium channel, and to maintain the temperature of the liquid to be stable (and to stabilize the temperature of the liquid).

According to the present invention, it is possible to stabilize the temperature of the liquid inside the liquid channel by the heating mechanism for example. Accordingly, it is possible to suppress the fluctuation (change) in the viscosity and the surface tension of the liquid, and to stabilize the transporting of liquid by the electrowetting.

BRIEF DESCRIPTION OF THE DRAWINGS

FIG. 7A shows a standby state, FIG. 7B shows a state at a start of transporting, FIG. 7C shows a state when ink is discharged, and FIG. 7D shows a state when the discharge is terminated;

DETAILED DESCRIPTION OF THE PREFERRED EMBODIMENTS

An embodiment of the present invention will be described below. The embodiment of the present invention will be described below by referring to FIGS. 1 to 7. The embodiment is an example in which the present invention is applied to a printer having an ink-jet head which transports the ink to a recording paper, and recording a desired image on the recording paper.

Figure 1:
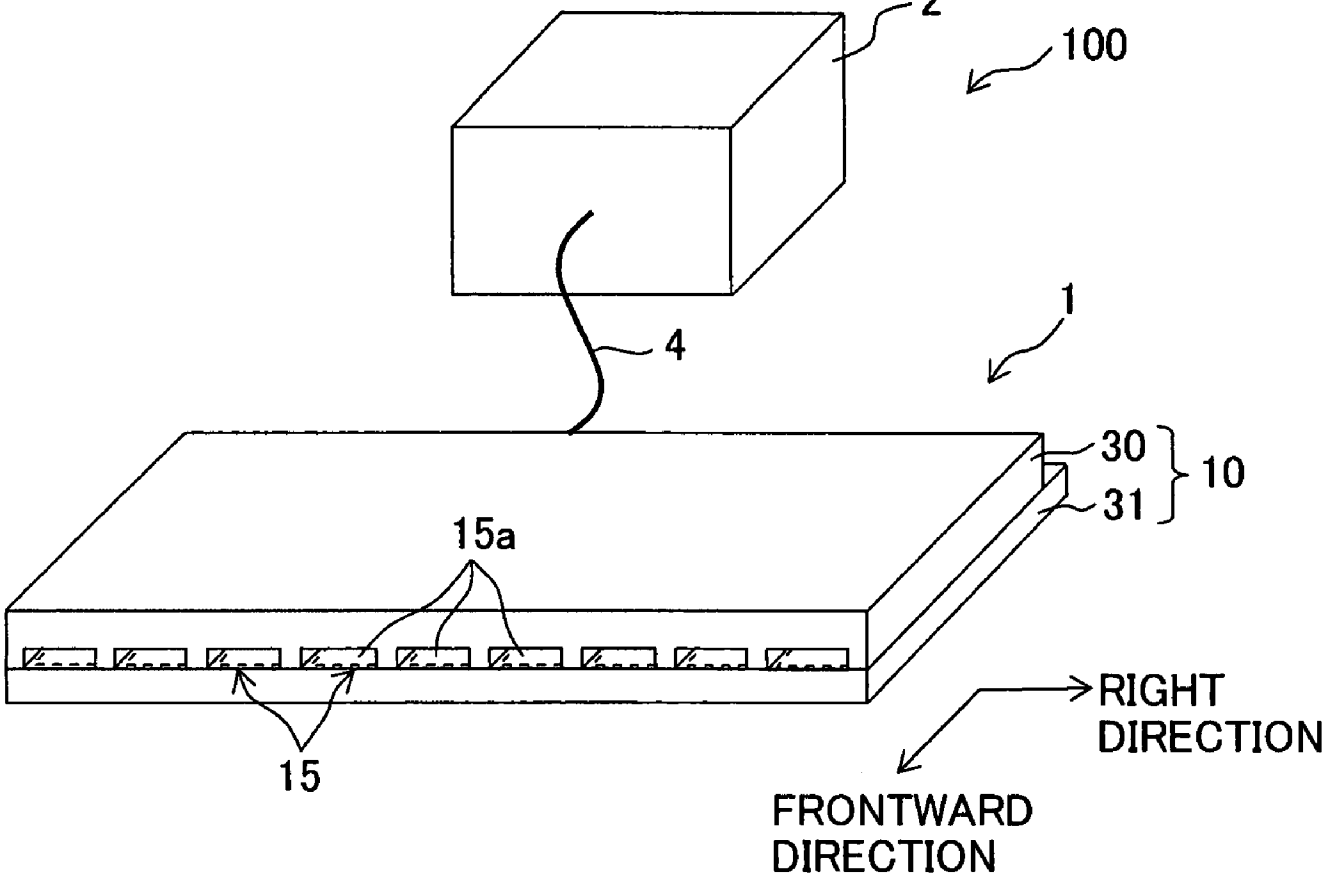
FIG. 1 is a perspective view showing a schematic structure of a printer according to an embodiment of the present invention.

FIG. 1 is a perspective view showing schematically a printer 100 of the embodiment. As shown in FIG. 1, the printer 100 includes an ink-jet head 1 (liquid transporting apparatus) including a plurality of individual channels 15 each provided with a jetting port 15*a*, an ink tank 2 which is connected to the ink-jet head 1 via a tube 4, and a control unit 3 (refer to FIG. 2) which controls the ink-jet head 1 to transport the ink to the jetting port 15*a*. Moreover, the printer 100 jets inks from the plurality of jetting ports 15*a* provided on a front-end surface of the ink-jet head 1, toward a recording paper P positioned at a front side of the jetting ports 15*a*, and records an image on the recording paper P. In the following description, a frontward direction, a rearward direction, a left side (left direction), and right side (right direction) are as defined in FIG. 1.

Figure 2:
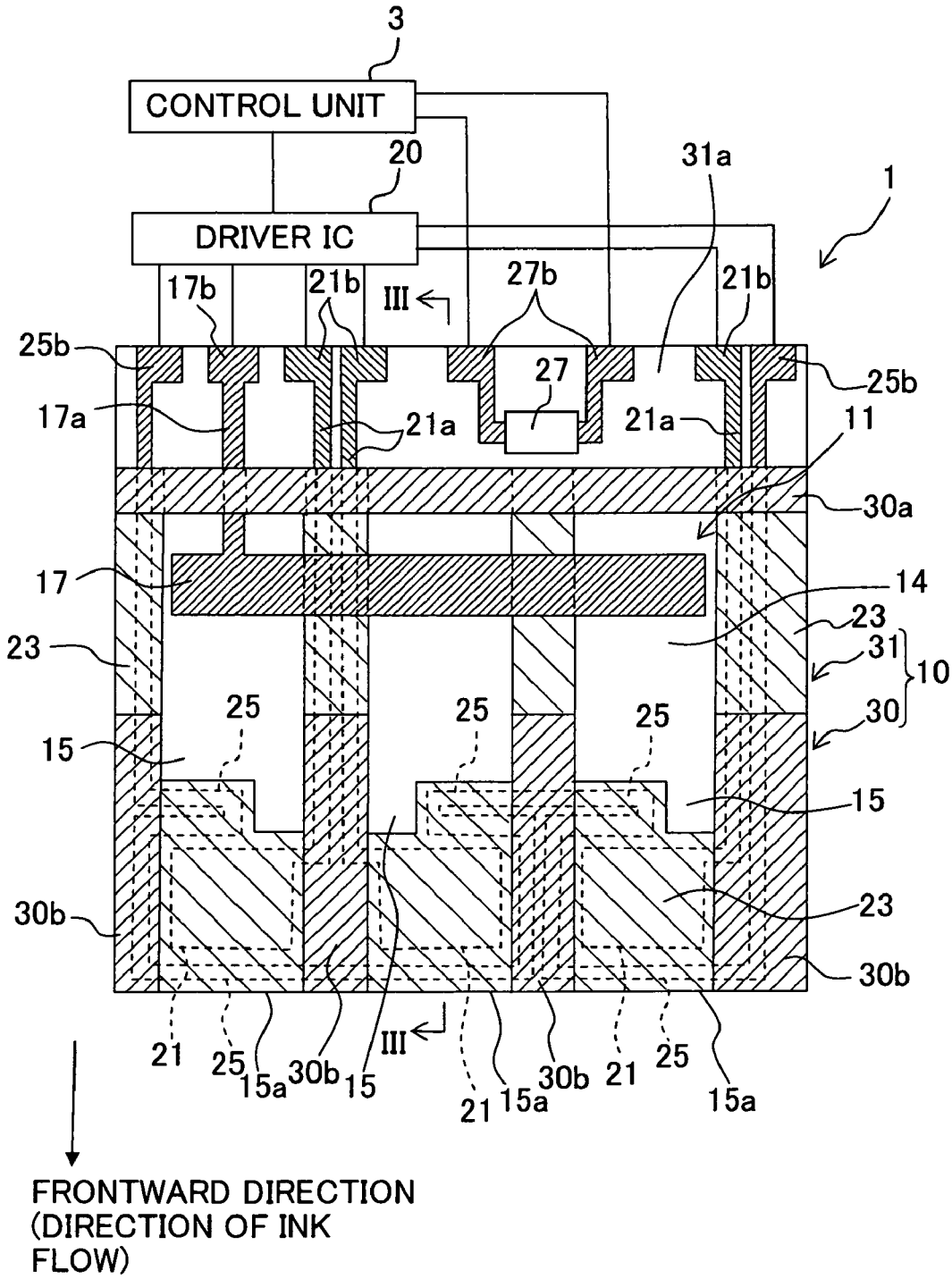
FIG. 2 is a horizontal cross-sectional view of a part of an ink-jet head.
Figure 3:
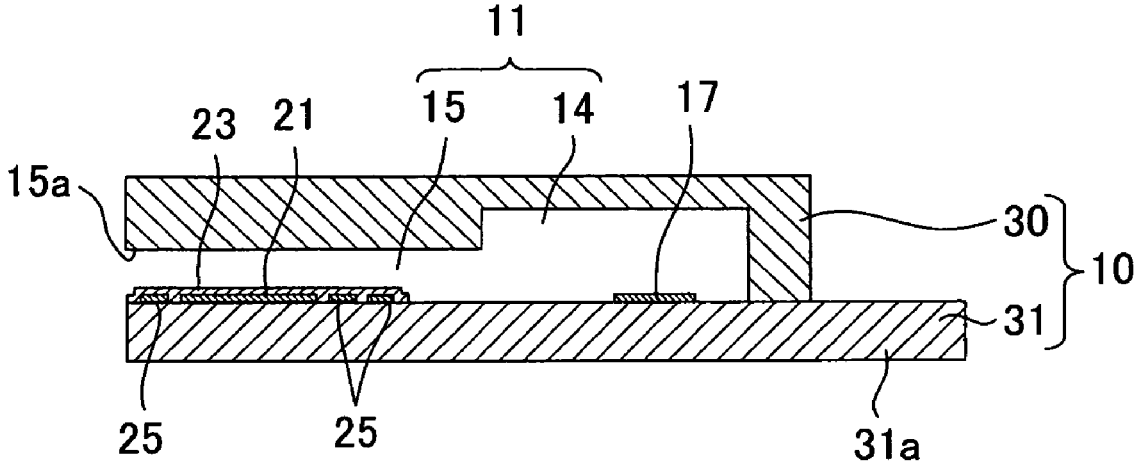
FIG. 3 is a cross-sectional view taken along a line III-III in FIG. 2.

Next, the ink-jet head 1 will be described below. FIG. 2 is a horizontal cross-sectional view of a part of the ink-jet head 1, and FIG. 3 is a cross-sectional view taken along a line III-III in FIG. 2. As shown in FIGS. 2 and 3, the ink-jet head 1 has a head body 10 in which an ink channel 11 through which an electroconductive ink flows is formed, a plurality of transporting electrodes 21 arranged on an inner surface of the ink channel 11, and an insulating layer 23 which is arranged on the inner surface of the ink channel 11, to cover the transporting electrodes 21. In this ink-jet head 1, when an electric potential of one of the transporting electrodes 21 is changed, a wetting angle of the ink with respect to a surface of the insulating layer 23 covering the transporting electrode 21 is changed, and this phenomenon is called as electrowetting. By using the electrowetting phenomenon, the ink is transported up to the jetting port 15*a* through the ink channel 11, and ink droplets are jetted from the jetting ports 15*a*, toward the recording paper.

As shown in FIG. 1, the head body 10 (channel forming body) has mainly two channel-forming members 30 and 31 each having a substantially flat shape and a rectangular shape which is elongated in a left-right direction in a plan view. The two channel-forming members 30 and 31 are joined to face with each other. The two channel-forming members 30 and 31 are made of a synthetic resin material such as polyimide, a glass material, and silicon on which an oxidized film is formed. On a surface of the two channel-forming members 30 and 31, an area in which a heat generator 25, wires 17*a* and 21*a*, and electrodes 17 and 21 which will be described later are formed, and another area contacting to the ink, have an insulating property.

Figure 4:
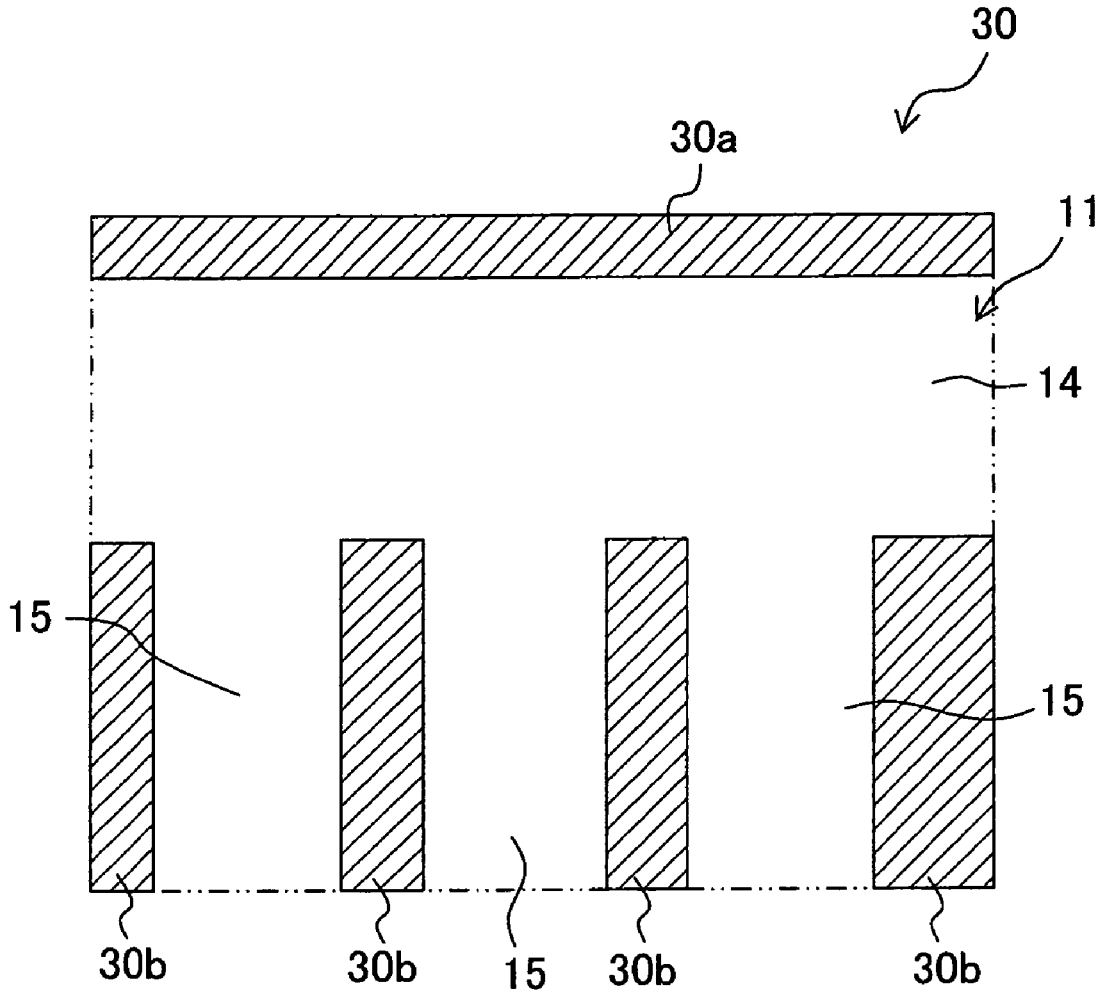
FIG. 4 is a horizontal cross-sectional view of a channel-forming member at an upper side.
Figure 5:
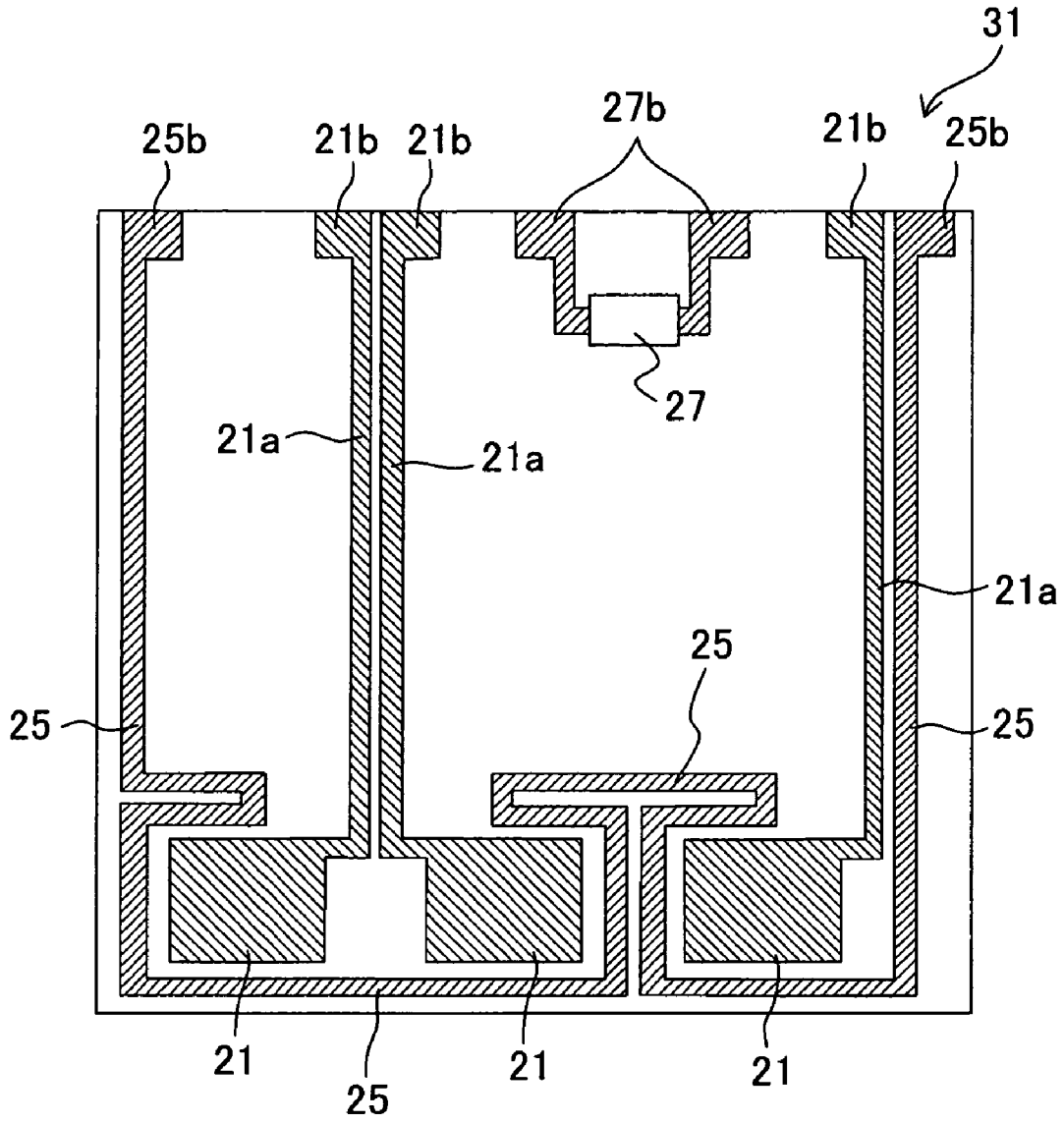
FIG. 5 is a top view of a channel-forming member at a lower side (with an insulating layer removed)

FIG. 4 is a horizontal cross-sectional view of the upper channel-forming member 30, and FIG. 5 is a top view of the lower channel-forming member 31. As shown in FIGS. 2 and 4, a wall 30*a* extended in a longitudinal direction (left-right direction) of a rear-end portion of the upper channel-forming member 30, and a plurality of partition walls 30*b* extended in a direction orthogonal to the longitudinal direction (backward and forward direction, anteroposterior direction) at a front-end portion of the upper channel-forming member 30 are formed on a rear surface (lower surface side) of the upper channel-forming member 30. By joining of a lower surface of the upper channel-forming member 30 to a flat upper surface of the lower channel-forming member 31, the ink channel 11 defined by the wall 30*a* and the plurality of partition walls 30*b* is formed between the two upper and lower channel-forming members 30 and 31.

More concretely, the ink channel 11 has a common ink chamber (common liquid chamber) 14 extended in a longitudinal direction of the channel-forming members 30 and 31, and a plurality of individual channels 15, each separated (isolated) mutually by the partition walls 30*b*, and extended frontward upon branching from the common ink chamber 14. In FIG. 2, three of individual channels 15 among the plurality of individual channels 15 provided to the head body 10 are shown. An electroconductive ink is used as an ink supplied to the ink-jet head 1 to flow through the ink channel 11, the electroconductive ink including an aqueous dye ink in which water as a main component, a dye and a solvent are mixed, and an aqueous pigment ink in which pigments and a solvent are mixed.

Moreover, as shown in FIGS. 1 and 2, a length in the backward and forward direction of the upper channel-forming member 30 is shorter than a length of the lower channel-forming member 31. Therefore, when the channel-forming members 30 and 31 are joined, a rear-end portion of the lower channel-forming member 31 is projected rearward, and forms a projected portion 31*a*. An upper portion of the projected portion 31*a* is exposed. Further, an end portion of the heat generator 25 and the wire 21*a* connected to the transporting electrode 21 which will be described later are drawn onto the exposed upper surface of a projected portion 31*a*.

The common ink chamber 14 is formed to be extended in a left-right direction in a rear-side portion of the two channel-forming members 30 and 31. Moreover, the common ink chamber 14 is connected to the ink tank 2 (refer to FIG. 1) via the tube 4. The ink supplied from the ink tank 2 to the ink-jet head 1 is supplied to each of the individual channels 15 via the common ink chamber 14. The ink tank 2 is arranged at a position slightly higher than the individual channels 15 in the ink-jet head 1. Therefore, a head pressure of the ink tank 2 acts all the time on the ink inside the individual channel 15, as a pressure to generate a flow of ink toward the jetting ports 15*a*.

As shown in FIG. 2 and FIG. 3, a common electrode 17 extended in a longitudinal direction of the channel-forming member 31 (the left-right direction) is formed on a bottom surface of the common ink chamber 14 (an upper surface of a rear-side portion of the lower channel-forming member 31), and the ink in the common ink chamber 14 comes in a direct contact with the common electrode 17. Moreover, the wire 17*a* which is extended rearward is connected to the common electrode 17, and furthermore, a contact portion 17*b* of an end portion of the wire 17*a* is drawn up to the exposed upper surface of the projected portion 31*a* of the channel-forming member 31. The contact portion 17*b* is connected to a driver IC 20 (driving mechanism) via a wire member such as a flexible substrate (FPC: Flexible Printed Circuit) which is not shown in the diagram, and the common electrode 17 is kept at a ground electric potential (reference electric potential) all the time by the drive IC 20. Consequently, an electric potential of the ink inside the common ink chamber 14 in contact with the common electrode 17 is kept at the ground electric potential all the time.

The individual channels 15 are mutually separated by the partition walls 30*b* formed on the upper channel-forming member 30, and each of the individual channels 15 is extended in parallel along a backward and forward direction. A plurality of jetting ports 15*a* (liquid jetting ports) each of which is opened frontward is formed at a front end of the individual channels 15. As shown in FIGS. 1 and 2, the jetting ports 15*a* are arranged in a row in the left-right direction on a front surface of the head body 10.

As shown in FIGS. 2 and 5, a plurality of rectangular shaped transporting electrodes 21 is formed on the individual channels 15 respectively, on a bottom surface (an upper surface of the channel-forming member 31 on a lower side) near the jetting port 15*a*. Wires 21*a* are connected to the transporting electrodes 21. The wires 21*a* are drawn from the transporting electrodes 21 in the left direction or the right direction, and further, are extended rearward at an area outside of the individual channel 15 in a left-right direction, (at the area to which the partition wall portion 30*b* is joined). Some of the wires 21*a* are extended across the common ink chamber 14. Furthermore, contact portions 21*b* (first contact portions) formed at end portions of the wires 21*a* are extended up to the upper surface of the projected portion 31*a* formed at a rear end portion of the channel-forming member 31. As it will be described later, the insulating layer 23 is provided on a surface of the transporting electrode 21, and as shown in FIGS. 2 and 3, the insulating layer 23 also covers the wires 21*a* which are drawn from the transporting electrodes 21. Accordingly, the wires 21*a* are insulated from the electroconductive ink flowing through the ink channel 11 and the common electrode 17 in the common ink chamber 14.

The plurality of contact portions 21*b* drawn from the plurality of transporting electrodes 21 to the projected portion 31*a* is connected to the driver IC 20 (a driving mechanism, an electric potential applying mechanism, and a power supply) via a wiring member such as a flexible substrate (not shown in the diagram). Based on a command from the control unit 3, a predetermined electric potential is applied to the transporting electrodes 21 by the driver IC 20 via the contact portions 21*b* and the wires 21*a*. Here, one of the ground electric potential and a predetermined driving electric potential which differs from the ground electric potential is selectively applied as the predetermined electric potential.

It is possible to form the transporting electrodes 21, the wires 21*a*, the contact portions 21*b*, the common electrode 17, the wires 17*a*, and the contact portions 17*b* described above on the upper surface of the lower channel-forming member 31 by a method such as a screen printing method, a vapor deposition method, and a sputtering method.

As shown in FIGS. 2 and 3, the insulating layer 23 is formed, on a bottom surface of the individual channel 15 at a portion near the jetting ports 15*a* on which the transporting electrodes 21 are formed, to cover the transporting electrodes 21 entirely. It is possible to form the insulating layer 23 by coating the upper surface of the channel-forming member 31 including the transporting electrodes 21 by a fluororesin, using a method such as a spin coating. As it has been mentioned above, the insulating layer 23 also covers the wires 21*a* drawn from the transporting electrodes 21. Therefore, the electroconductive ink flowing through the ink channel 11 is prevented assuredly from being adhered to the wires 21*a*. Moreover, it is possible to superimpose (overlap) the common electrode 17 and the wires 21*a* of the transporting electrodes 21, in the common ink chamber 14. Consequently, it is not necessary to draw the wires 21*a* to avoid overlapping with the common electrode 17. For example, it is possible to draw the wire 21*a* straight rearward, intersecting the common ink chamber 14, and the drawing around of the wires 21*a* becomes easy.

Here, when the electric potential of the transporting electrodes 21 is kept at the ground electric potential by the driver IC 20, there is no electric potential difference between the transporting electrodes 21 and the ink which is at the ground electric potential due to the common electrode 17. Then a liquid repellent property of a surface of the insulating layer 23 is superior to a liquid repellent property of the channel-forming members 30 and 31 forming the bottom of the individual channel 15. In other words, a wetting angle θ of the ink with respect to the surface of the insulating layer 23 is larger than a wetting angle at an area on an inner surface of the individual channel 15 in which the insulating layer 23 is not formed. Therefore, in this case, the ink cannot move onto the surface of the insulating layer 23.

On the other hand, when a predetermined driving electric potential which differs from the ground electric potential is applied to the transporting electrodes 21 by the driver IC 20, an electric potential difference is generated between the ink in the individual channel 15 and the transporting electrode 21. Then, a surface energy between the ink and the insulating layer 23 changes due to the electric potential difference, and the wetting angle of the surface of the insulating layer 23 changes depending on the change in the surface energy.

Figure 6:
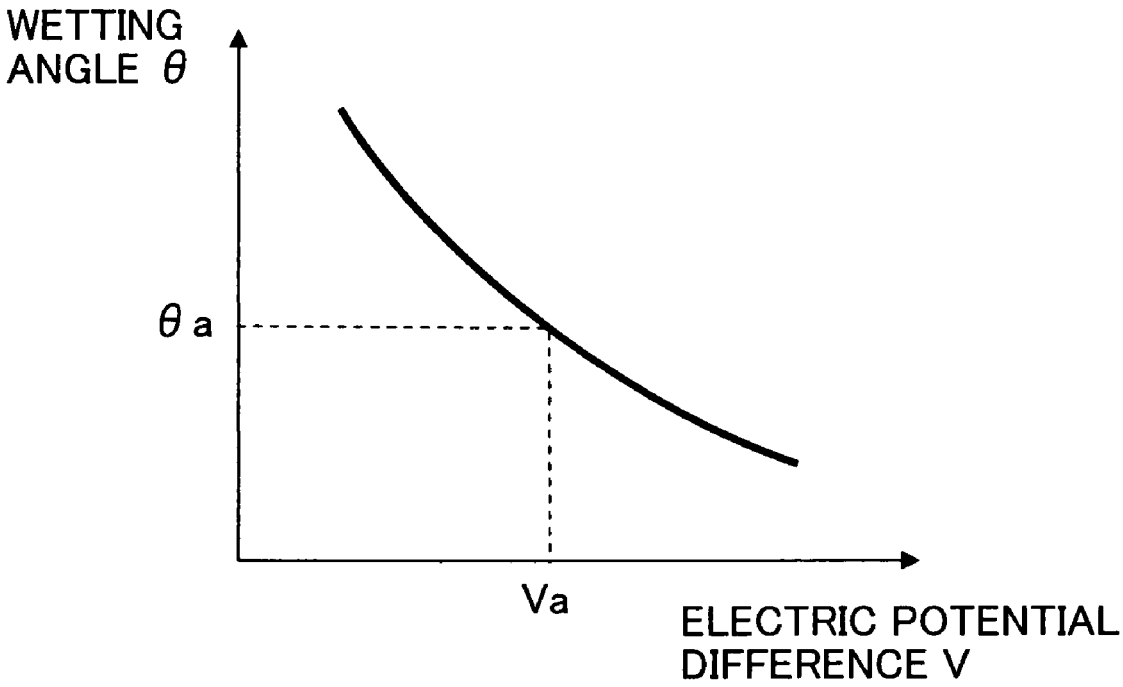
FIG. 6 is a diagram showing a relationship between an electric potential V between an ink and a transporting electrode, and a wetting angle θ of a surface of the insulating layer covering the transporting electrode.

FIG. 6 is a diagram showing a relationship between an electric potential difference V between the ink and the transporting electrodes 21 and the wetting angle θ at the surface of the insulating layer 23 covering the transporting electrode 21. As shown in FIG. 6, as the electric potential difference V between the ink and the transporting electrode 21 increases, the wetting angle θ of the ink with respect to the surface of the insulating layer 23 decreases (an electrowetting phenomenon). Moreover, in the individual channels 15, when the electric potential difference V between the ink and the transporting electrodes 21 is not less than a critical electric potential difference Va shown in FIG. 6, the wetting angle θ at the surface of the insulating layer 23 is decreased up to a predetermined critical wetting angle θa at the surface of the insulating layer 23 or less. As a result, the ink can move onto an area, of the insulating layer 23, covering the transporting electrodes 21 to which the driving electric potential is applied.

A series of operations of transporting the ink in which the driver IC 20 changes the electric potential of the transporting electrodes 21 will be described with reference to FIGS. 7A to 7D. In FIGS. 7A to 7D, '+' sign indicates the driving electric potential (for example, 30 V) applied to the transporting electrodes 21, and 'GND' sign indicates the ground electric potential applied to the transporting electrodes 21.

Figure 7A:
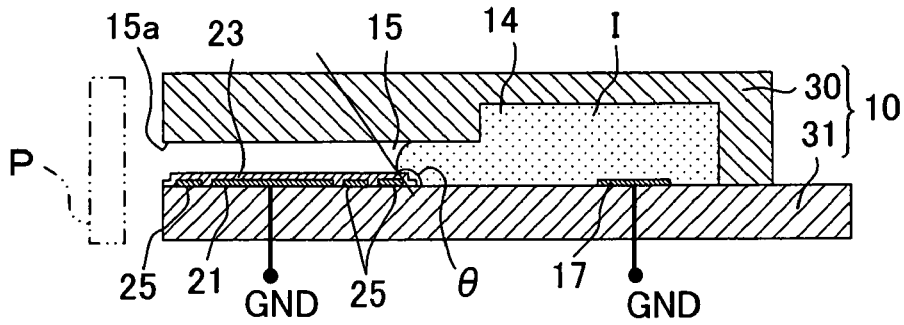
FIG. 7A, FIG. 7B, FIG. 7C, and FIG. 7D are diagram describing an ink transporting operation where.

As shown in FIG. 7A, when the electric potential of the transporting electrode 21 is kept at the ground electric potential by the driver IC 20, the wetting angle θ of the ink with respect to the area of the insulating layer 23 covering the transporting electrodes 21 is larger than the critical wetting angle θa. Therefore, the ink I cannot move into this area. At this time, a meniscus of the ink I is formed at an upstream end position of the insulating layer 23, and the ink I is not jetted from the jetting ports 15*a* (standby state).

Figure 7B:
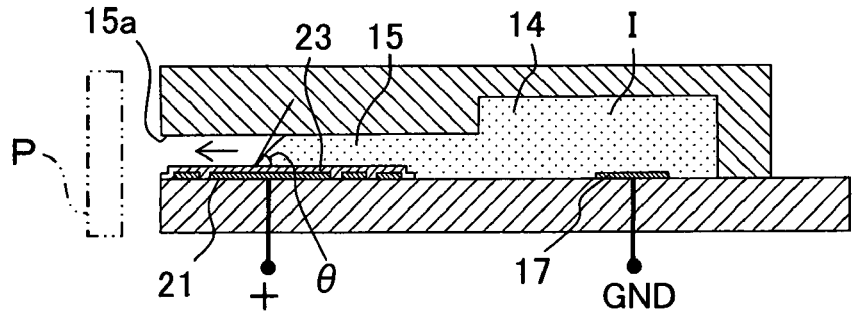
Figure 7C:
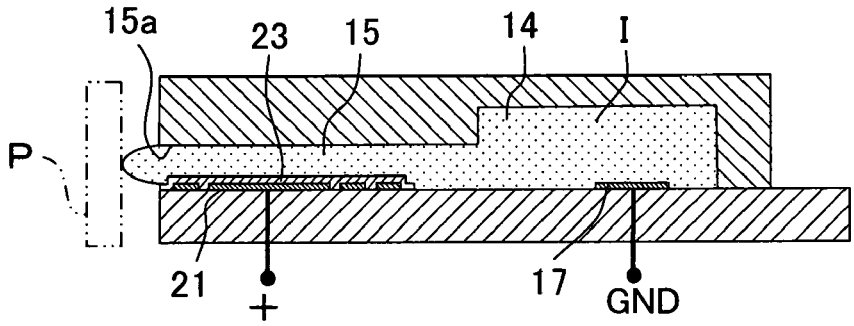

Next, as shown in FIG. 7B, when the electric potential of the transporting electrodes 21 is switched from the ground electric potential to the driving electric potential by the driver IC 20, the wetting angle θ of the ink I with respect to the insulating layer 23 covering the transporting electrodes 21 is decreased up to critical wetting angle θa or less. As a result, the meniscus of the ink I starts moving from the upstream side to the surface of the insulating layer 23. Furthermore, as shown in FIG. 7C, the ink I which has moved from the upstream side, reaches the jetting port 15*a* due to an action of a back pressure (head pressure of the ink tank 2), and is discharged from the jetting ports 15*a* and is adhered to the recording paper P.

Figure 7D:
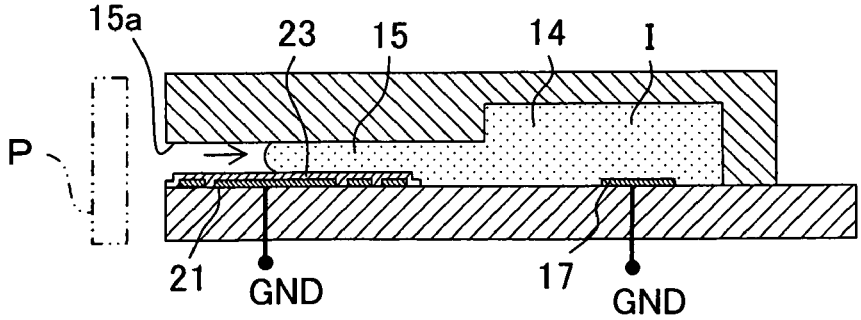

Thereafter, as shown in FIG. 7D, when the electric potential of the transporting electrodes 21 is switched from the driving electric potential to the ground electric potential, the wetting angle θ of the ink I with respect to the insulating layer 24 covering the transporting electrodes 21 becomes larger, and the ink I cannot remain on the surface of the insulating layer 23. Consequently, the meniscus of the ink I moves back, and returns to a standby state shown in FIG. 7A.

The critical wetting angle θa, at which the ink starts moving onto the area of the insulating layer 23 covering the transporting electrodes 21, changes according to the head pressure of the ink tank 2 acting on the ink in the individual channel 15, and a shape of the individual channel 15. In addition, the critical wetting angle θa is also affected by a surface tension and a viscosity of the ink.

When a temperature of the ink in the ink channel 11 fluctuates due to a heat imparted from an outside and a fluctuation in an environmental temperature, the surface tension of the ink is changed in accordance with the fluctuation in the temperature of the ink. Consequently, the wetting angle is changed due to the temperature fluctuation of the ink. Therefore, for example, in case the wetting angle becomes larger than an expected value due to the change in the surface tension, even when the driving electric potential corresponding to the expected value is applied to the transporting electrodes 21, there is a fear that the wetting angle θ cannot be smaller than the critical wetting angle θa. In such case, a problem that the ink does not flow through the individual channels 15 may arise. Moreover, when the viscosity of the ink changes due to a fluctuation in an environmental temperature and heat imparted from an outside, a velocity of movement of the ink on the insulating layer 23, and a flow resistance of the ink in the liquid channel change. In such case, a problem that a timing at which the ink reaches the jetting ports 15*a* is changed, may arise. In such manner, due to the fluctuation in the temperature of the ink, there is a fear that the transporting of the ink using the electrowetting phenomenon becomes unstable.

Therefore, in the ink-jet head 1 of the embodiment, for stabilizing the temperature of the ink in the ink channel 11, the heat generator 25 (heating mechanism) which heats the ink has been provided. As shown in FIGS. 2, 3, and 5, one long heat generator 25 is drawn around the bottom surface of the individual channel 15 in which the transporting electrodes 21 are arranged (the upper surface of the lower channel-forming member 31). Accordingly, a portion of the heat generator 25 is arranged at the upstream side of the transporting electrode 21 in the flow direction of the ink and another portion of the heat generator 25 is arranged at the downstream side of the transporting electrode 21 in the flow direction. In other words, one heat generator 25 is provided commonly among the plurality of individual channels 15 (three individual channels 15 in FIG. 2).

Two contact portions 25*b* (second contact portion) provided at both end portions of the heat generator 25*a* are drawn up to the upper surface of the projected portion 31*a* formed on the rear end portion of the channel-forming member 31. Furthermore, the two contact portions 25*b* are connected to the driver IC 20 (driving mechanism) via a wiring member (not shown in the diagram) such as a flexible substrate. When an electric power is supplied to the heat generator by applying a voltage between the two contact portions 25*b* by the driver IC 20, the heat generator 25 which is an electric resistor generates heat, and the ink inside the individual channel 15 is heated.

As a heat generating material which generates heat upon supplying the electric power, to be used as such heat generator 25, it is possible to use a material such as graphite, carbon, PG/PBN (pyrolytic graphite/pyrolytic boron nitride), aluminum nitride, and tungsten. Moreover, it is possible to form the heat generator 25 by adhering such heat generating material directly on the upper surface of the channel-forming member 31 by using a film forming method such as an aerosol deposition method, a sputtering method, a vapor deposition method, and a sol-gel method. Alternatively, a known heater such as nichrome wire may be used.

The heat generator 25 is formed on the bottom surface of the individual channel 15, same as the transporting electrodes 21. As shown in FIGS. 2 and 3, the abovementioned insulating layer 23 covers the heat generator 25. In this manner, since the transporting electrodes 21 covered by the insulating layer 23 is provided on the bottom surface of the individual channel 15, the heat generator 25 and the electroconductive ink are insulated. Accordingly, when the electric power is supplied to the heat generator 25, the electric potential of the ink does not fluctuate, and there is no short circuit. Moreover, since the heat generator 25, which is formed of an electroconductive material, and the transporting electrode 21 are covered by the insulating layer 23 commonly, a structure for insulating the heat generator 25 from the ink becomes simple. In other words, when the transporting electrodes 21 (and the wire 21*a*) and the heat generator 25 are formed on the upper surface of the channel-forming member 31, and they are commonly covered by the insulating layer 23, it is possible to insulate the transporting electrodes 21 and to insulate the heat generator 25 simultaneously.

Since the heat generator 25 is arranged at the upstream side of the transporting electrode 21 in the flow direction, the ink immediately before moving onto the transporting electrodes 21 is heated in each of the individual channels 15. Therefore, it is possible to transport stably the ink on the surface of the insulating layer 23 covering the transporting electrodes 21. However, when the heat generator 25 is arranged on the upstream side of the transporting electrodes 21, the following problem may arise. Even when the wetting angle on the surface of the insulating layer 23 in the area covering the transporting electrodes 21 is decreased locally due to the driving electric potential applied to the transporting electrodes 21, there is an area having a superior liquid repellent property made of the insulating layer 23 covering the heat generator 25 prior to the electrodes 21. Therefore, the area having the superior liquid repellent property of the insulating layer 23 covering the heat generator 23 becomes a barrier, and the ink at the upstream side hardly reaches up to the area in which the liquid repellent property of the insulating layer 23 has declined. In view of this, in this embodiment, at the upstream side of the transporting electrode 21, the heat generator 25 is arranged only in a part of the area in a direction of a channel width of the individual channels 15 (area on one side occupying almost half of the channel width). Therefore, when the liquid repellent property of the insulating layer 23 on the transporting electrode 21 is declined, the ink can move easily from the upstream side of the individual channel 15 to that area.

Furthermore, in addition to the heat generator 25 provided at the upstream side of the transporting electrodes 21 in the flow direction, since the heat generator 25 is also provided at the downstream side of the transporting electrodes 21 in the flow direction, the ink is heated simultaneously at the upstream side and the downstream side of the transporting electrodes 21, and the temperature of the ink inside the individual channels 15 is stabilized.

Moreover, since the heat generator 25 is provided commonly among the plurality of individual channels 15, it is possible to heat the ink in the plurality of individual channels 15 by one heat generator 25, and a structure for heating the ink becomes simple.

Furthermore, since the driver IC 20 which applies the driving electric potential to the transporting electrodes 21 also applies the voltage between the two contact portions 25*b* of the heat generator 25, the driver IC 20 is also capable of supplying the electric power to the heat generator 25. In other words, since one driver IC 20 is capable of applying the electric potential to the transporting electrode 21 and to supply the electric power to the heat generator 25, an electrical structure of the liquid transporting apparatus becomes simple.

As shown in FIGS. 2 and 5, a thermistor 27 which detects the temperature of the ink in the ink channel 11 is provided on the upper surface of the projected portion 31*a* of the lower channel-forming member 31. The thermistor 27 is connected to the control unit 3 via a wiring member (not shown in the diagram) such as a flexible substrate.

As it has been described above, all the components namely, the contact portions 21*b* of the transporting electrodes 21, the contact portions 17*b* of the common electrode 17, the contact portions 25*b* of the heat generator 25, and (a contact portion 27*b* of) the thermistor 27 are provided at the rear end portion (projected portion 31*a*) of the channel-forming member 31 of the head body 10. Therefore, it becomes easy to connect these contact portions 17*b*, 21*b*, 25*b* and 27*b* to the driver IC 20 and the control unit 3 by using a flexible substrate etc. Furthermore, these contact portions 17*b*, 21*b*, 25*b*, and 27*b* are provided to an end portion of the head body 10, on an opposite side of the plurality of jetting ports 15*a*. Therefore, even when the number of the jetting ports 15*a* and the individual channels 15 to be provided to the head body 10 is large, and when the jetting ports 15*a* and the individual channels 15 are sought to be arranged highly densely at a front-end portion of the head body 10, it is possible to draw the contact portions to a rear-end portion of the head body 10. Therefore, drawing around of the heat generator 25 and the wires 21*a* of the transporting electrodes 21 becomes easy.

Next, a structure of the control unit 3 will be described below. The control unit 3 shown in FIG. 2 includes a central processing unit (CPU), a ROM (Read Only Memory) in which various computer programs and data for controlling an overall operation of the printer 1 are stored, and a RAM (Random Access Memory) which temporarily stores data to be stored by the CPU. Moreover, the control unit 3 controls various operations of the printer 100. For example, the control unit 3 controls the driver IC 20 which applies the electric potential to the transporting electrodes 21 and/or a paper feeding mechanism (not shown in the diagram) which transports the recording paper P, so as to jet the ink from desired jetting ports 15*a* of the ink-jet head 1 based on data input from an outside from a PC etc.

A temperature detection signal from the thermistor 27 is input to the control unit 3 (temperature controlling mechanism). Based on the temperature of the ink detected by the thermistor 27, the control unit 3 controls the heat generator 25 such that the temperature of the ink falls within a certain range. For example, it is possible to control the heat generator 25 to maintain the temperature of the ink at 40±2° C. Concretely, the control unit 3 controls the electric power supplied to the heat generator 25 of the driver IC 20. Accordingly, it is possible to stabilize assuredly the temperature of the ink.

As it has been described above, since the ink-jet head in the embodiment has the heat generator 25 which heats the ink inside the ink channel 11, it is possible to stabilize the temperature of the ink. Consequently, it is possible to suppress the change in the viscosity and the surface tension due to the fluctuation in the temperature of the ink, and to stabilize the transporting of the ink by the electrowetting.

Next, modified embodiments in which various modifications are made in the embodiment described above will be described below. Same reference numerals are assigned to components having the similar structure as in the embodiment, and the description of such components is omitted.

Figure 8:
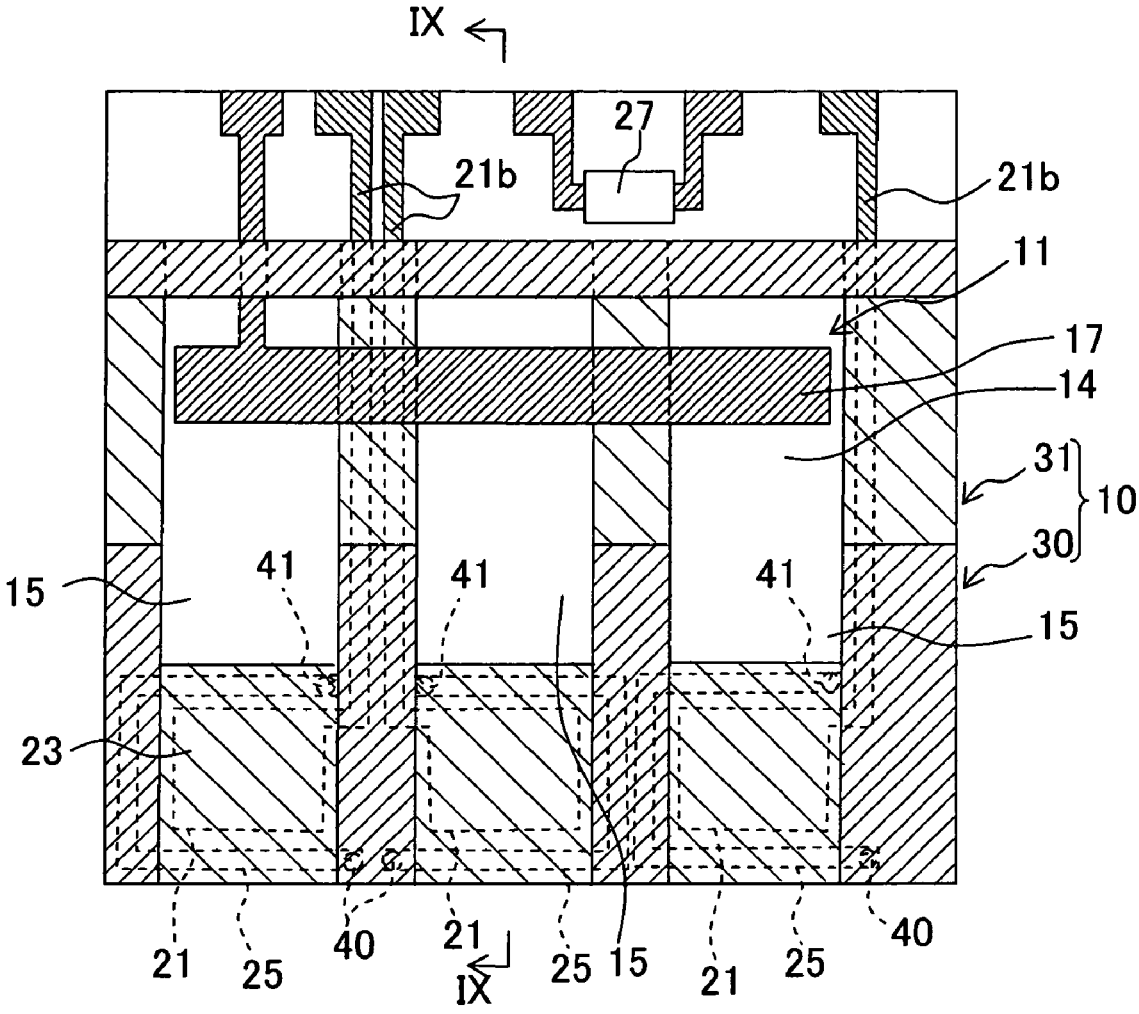
FIG. 8 is a horizontal cross-sectional view of an ink jet head according to a modified embodiment.
Figure 9:
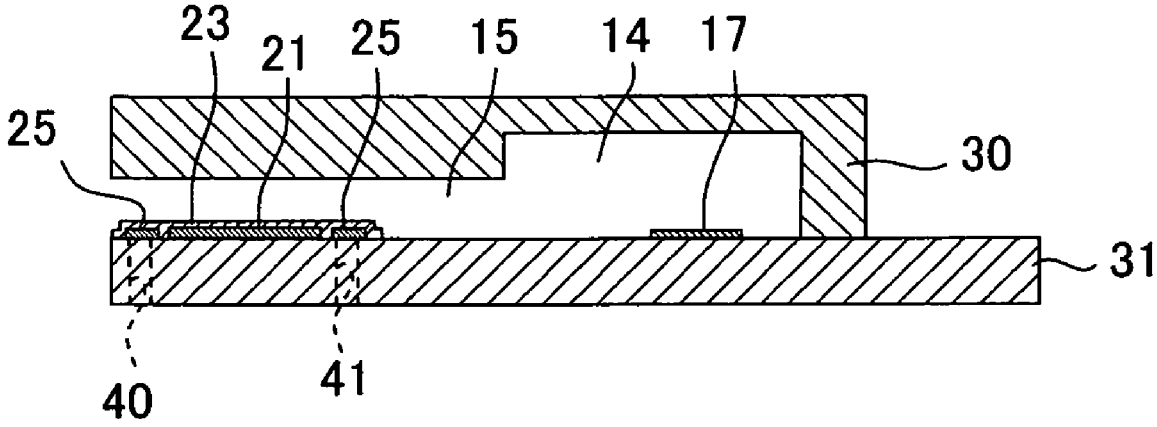
FIG. 9 is a cross-sectional view taken along a line IX-IX in FIG. 8.

In the embodiment described above, the contact portions at the both ends of the heat generator 25 to be connected to the driver IC 20 are drawn on the upper surface of the channel-forming member 31 (refer to FIG. 2) similarly as the contact portions 21*b* of the transporting electrodes 21. However, as shown in FIGS. 8 and 9, both ends of a portion, corresponding to each transporting electrode 21, of heat generator 25 may be drawn up to a rear surface (lower surface) of the channel-forming member 31 via through holes 40 and 41 formed in the channel-forming member 31. Moreover, the drawing around of the wire on the rear surface of the channel-forming member 31 may be arbitrary. The heat generator 25 provided to each individual channel 15 may be wired to be connected in series, or the heat generator 25 provided to each individual channel 15 may be wired to be connected in parallel.

In the abovementioned embodiment, the heat generator 25 is formed as an integrated component. However, the heat generator 25 may be provided separately for each individual channel 15. The heat generators 25 provided to the individual channels 15 respectively, may be connected mutually by electric wires such as conductors, or may be connected independently to the driver IC 20. When the heat generators 25 provided to the individual channels 15 respectively, are mutually wired by conductors etc., the heat generators 25 may be connected in series or may be connected in parallel.

In the abovementioned embodiment, the heat generator 25 is provided on the bottom surface of the individual channel 15 at both the upstream side and the downstream side of the transporting electrodes 21 in the flow direction. However, the position at which the heat generator 25 is to be provided is not restricted to this position.

Figure 10:
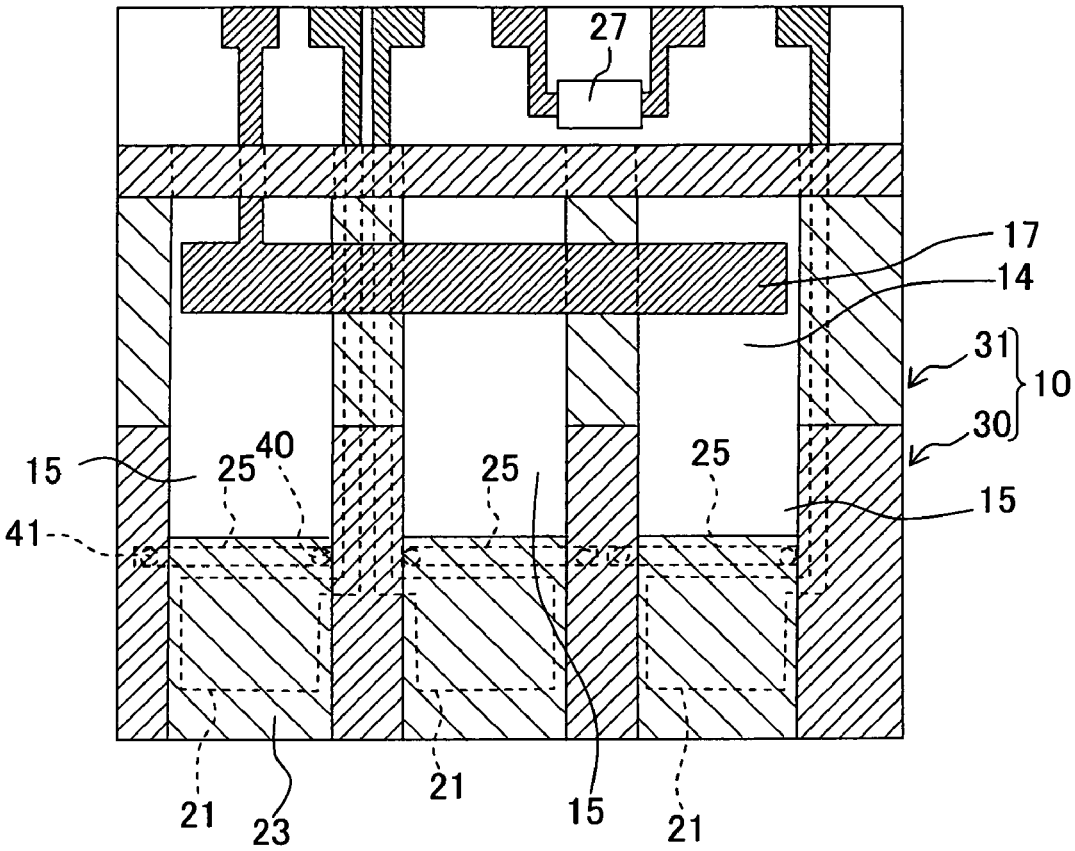
FIG. 10 is a horizontal cross-sectional view of an ink-jet head according to another modified embodiment.

For instance, it is possible to omit any one of the heat generators at the upstream side and the downstream side of the transporting electrodes 21. However, when the heat generator is provided at the upstream side of the transporting electrodes 21, it is possible to heat the ink immediately before being transported on the transporting electrodes 21. Therefore, an effect of stabilizing the transporting of the ink is substantial. From this viewpoint, when one of the heat generators at the upstream side and the downstream side is to be omitted, as shown in FIG. 10, it is preferable that the heat generator at the downstream side in the flow direction is omitted, and the heat generator 25 only at the upstream side is provided. In FIG. 10, an example in which the heat generator 25 is drawn on the rear surface of the channel-forming member 31 via the through holes 40 and 41 is shown. However, similarly as in the embodiment described above, the heat generator 25 provided on the upstream side of the transporting electrode 21 may be drawn rearward on the upper surface of the channel-forming member 31.

Figure 11:
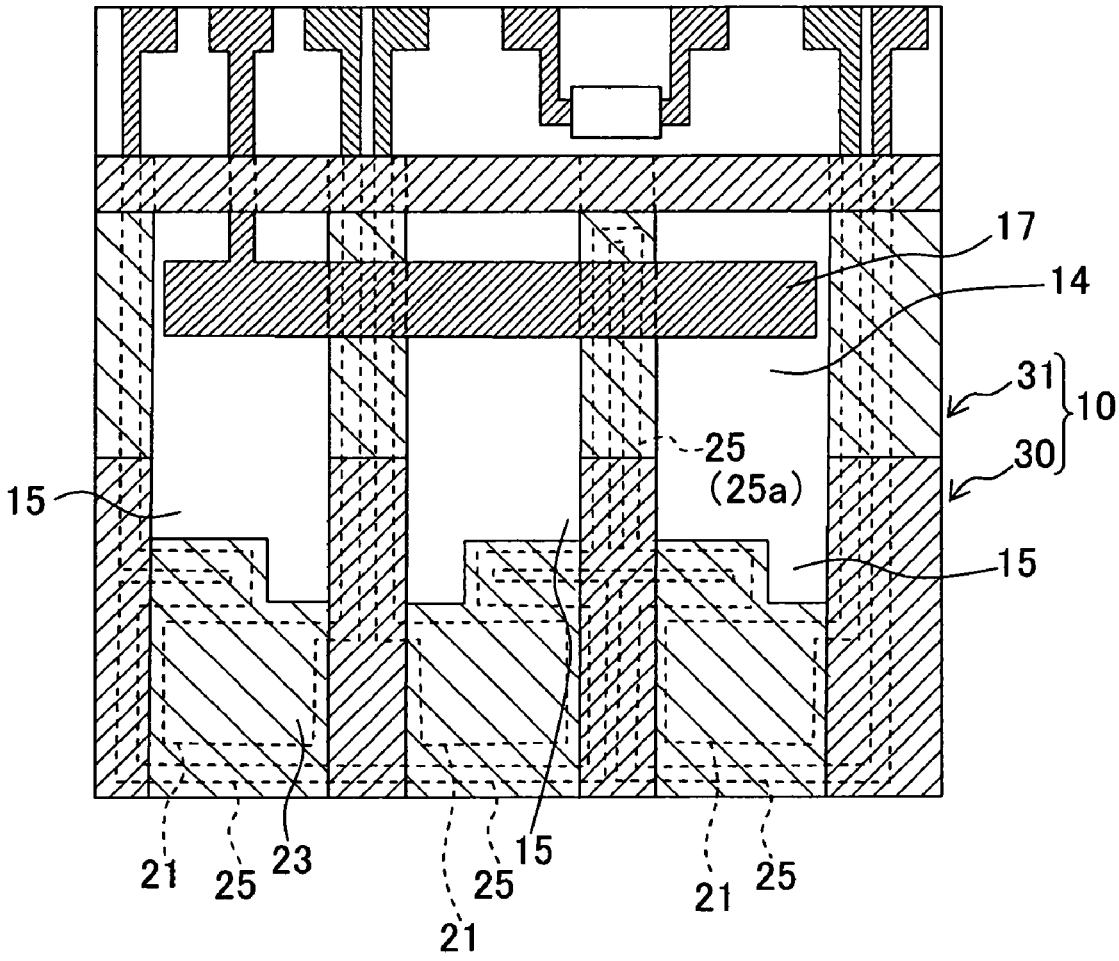
FIG. 11 is a horizontal cross-sectional view of an ink-jet head according to still another embodiment.

Moreover, as shown in FIG. 11, the heat generator 25 may be provided also on a bottom surface of the common ink chamber 14 (an extended portion 25*a* in FIG. 11). In this case, since the ink is heated inside the common ink chamber 14 before being branched to the plurality of individual channels 15, a variation in the temperature of the ink in the plurality of individual channels 15 is suppressed. In FIG. 11, the heat generator 25 is provided to the bottom surface of both the common ink chamber 14 and the individual channel 15. However, the heat generator 25 may be provided only to the common ink chamber 14 at the upstream side, and the heat generator in the individual channel 15 may be omitted.

Figure 12:
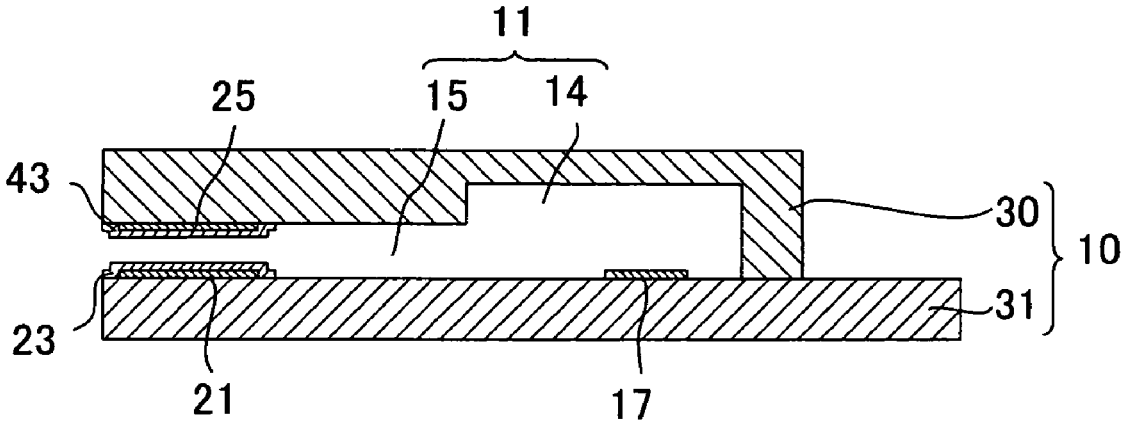
FIG. 12 is a vertical cross-sectional view corresponding to FIG. 3, of an ink-jet head according to still another embodiment.

Moreover, the heat generator 25 may be provided to be thermally conductive with the ink inside the ink channel 11 (the common ink chamber 14 and the individual channel 15), and may not be necessarily required to be provided on the bottom surface (surface on which the transporting electrode 21 is arranged) of the ink channel 11 (the common ink chamber 14 and the individual channel 15). For instance, as shown in FIG. 12, the heat generator 25 may be provided on a ceiling surface of the ink channel 11 (the individual channel 15 in FIG. 12). In this case, since the transporting electrode 21 and the heat generator 25 are arranged on different surfaces, the heat generator 25 is covered by an insulating layer 43 which is different from the insulating layer 23 covering the transporting electrodes 21. Moreover, the heat generator 25 may be provided on a side surface of the ink channel 11. Furthermore, the heat generator 25 may be provided only under (beneath) the partition wall 30*b*. Even in this case, the heat is transmitted to the ink inside the ink channel 11 through the partition wall 30*b*, and the ink flowing through the ink channel 11 is heated. Moreover, when the heat generator 25 and the electrode (the transporting electrode 21 or the common electrode 17) are insulated, the heat generator 25 and the electrode may be arranged to overlap (coincide) in a plan view. For instance, the electrode may be arranged on the heat generator 25, and furthermore, an insulating film may be formed between the heat generator 25 and the electrode.

Moreover, the heat generator 25 may be provided on an outer surface of the head body 10 (channel-forming members 30 and 31). In this case, due to the heat from the heat generator 25 provided on the outer surface of the head body 10 being transmitted from the outer surface to the inner surface of the head main body 10, the ink flowing through the ink channel 11 at an interior of the head main body 10 is heated.

In the abovementioned embodiment, a surface of the channel-forming members 30 and 31, on which the common electrode 17 and the transporting electrodes 21, the wires 17*a* and 21*a*, and the heat generator 25 are formed, and a surface which comes in contact with the ink have an insulating property. Here, it is necessary that the surface of the channel-forming members 30 and 31, on which the transporting electrode 21, the wires 21*a*, and the heat generator 25 are formed, have an insulating property, but a portion other than this surface (and the remaining portion) may be electroconductive. For instance, when a portion of the channel-forming members 30 and 31, which comes in contact with the ink is electroconductive, since it is possible to let the electric potential of the ink to be the ground electric potential, it is possible to omit the common electrode 17 to simplify the structure of the liquid transporting apparatus.

Figure 13:
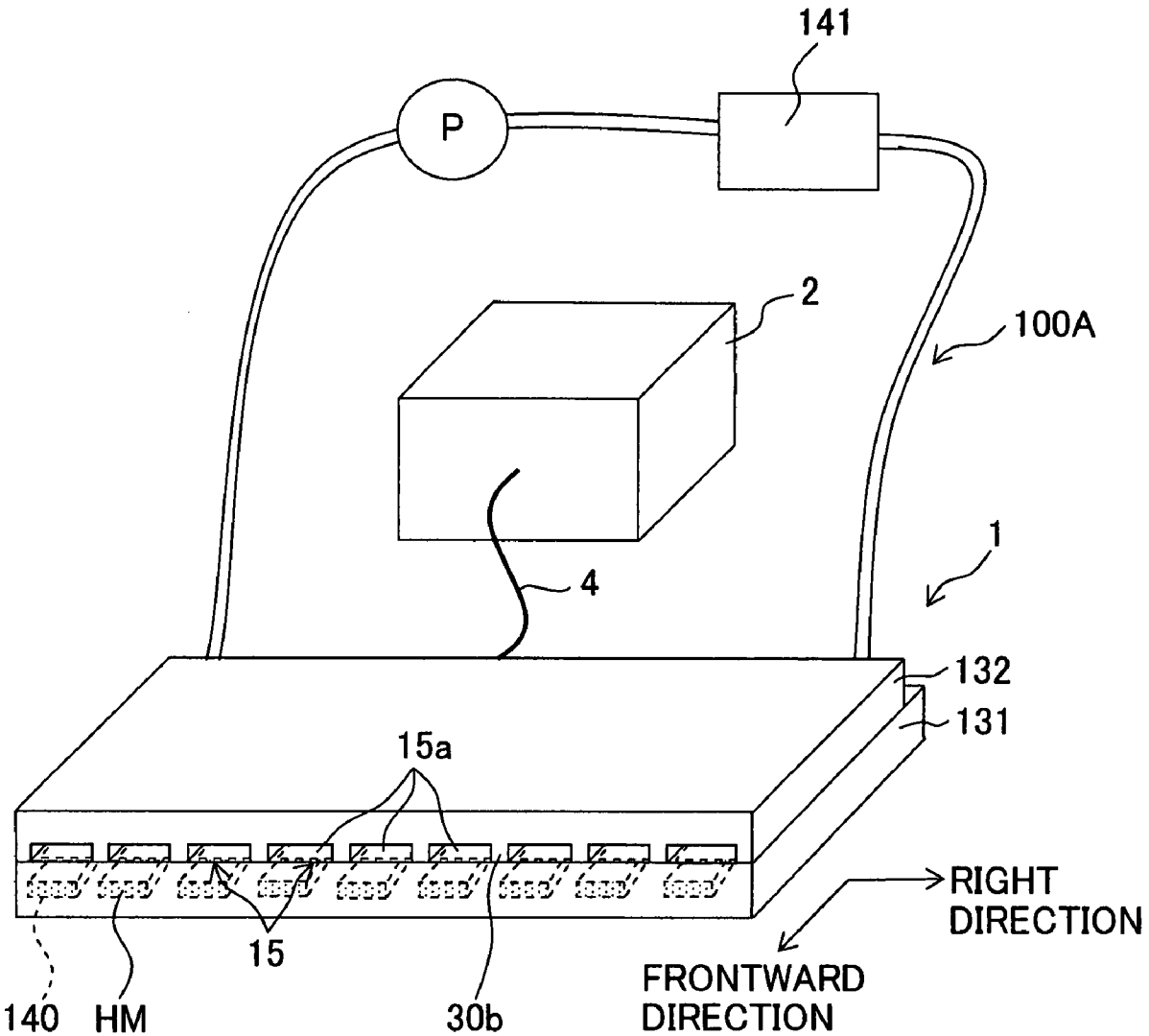
FIG. 13 is a liquid transporting apparatus in which a channel which circulates a heat transfer medium is formed.

In the abovementioned embodiment, the temperature of the ink is maintained at the predetermined temperature by heating a liquid such as an electroconductive ink by a heat generator. However, the present invention is not restricted to this. For instance, a liquid transporting apparatus 100A shown in FIG. 13 includes a channel-forming member 131 in which a channel (heat transfer medium channel) 140 which circulates a heat transfer medium HM having a fluidity which is adjusted at a predetermined temperature is formed, a circulating mechanism such as a pump P which circulates the heat transfer medium HM, and a temperature control mechanism (heat transfer medium temperature control mechanism) 141 which maintains the heat transfer medium HM at a predetermined temperature. The channel 140 is formed under (beneath) the ink channel 11, along the ink channel 11. By circulating the heat transfer medium HM which is subjected to temperature control, through the channel 140 formed in the channel-forming member 131 in such manner, it is possible to maintain the temperature of the ink inside the ink channel at the predetermined temperature. For example, by circulating water having the temperature controlled at 25° C., as the heat transfer medium, it is possible to maintain the temperature of the ink at about 25° C. despite the ambient temperature. In this case, it is possible not only to maintain the temperature of the ink to be constant by heating the ink, but also to maintain the temperature of the ink to be constant by cooling the ink.

The channel 140 may be provided to be thermally conductible with the ink inside the ink channel 11, and may not be necessarily provided along the ink channel 11. For example, the channel 140 may be formed along the partition wall 30*b*, under (beneath) the partition wall 30*b*. Alternatively, the channel 140 may be formed on a channel-forming member 132 at an upper side. Moreover, the heat transfer medium HM is not restricted to water, and it is possible to use an alcohol, a heat transfer medium oil such as silicone oil, a gas, and an aerosol. Particularly, when the heat transfer medium HM is to be maintained at a comparatively higher temperature (not less than 100° C. for example), it is preferable to use a heat transfer medium oil such as silicone oil instead of water. The circulating mechanism which circulates the heat transfer medium is not necessarily required. However, the circulating mechanism is effective for maintaining the temperature of the heat transfer medium to be stable.

The abovementioned embodiment is an example in which the present invention is applied to a printer which jets an ink toward the recording paper P by transporting the electroconductive ink up to the jetting port 15*a*. However, the application of the present invention is not restricted to such printer.

For instance, the present invention is applicable to an apparatus which adheres a solder in a melted form made of an alloy of metals such as tin (Sn), lead (Pb), or zinc (Zn) by transporting to the jetting ports 15*a*. In this manner, when the liquid transporting apparatus is an apparatus which transports the melted solder, it is possible to use the heat generator 25 for maintaining a temperature of the solder at a melting temperature (for example, about 200° C.) in addition to stabilizing the transporting of the melted solder by the electrowetting. In other words, by controlling the heat generator 25 (the driver IC 20 which supplies the electric power to the heat generator 25) such that the temperature of the solder is not less than the melting temperature thereof, based on the temperature which is detected by a temperature detecting mechanism such as the thermistor 27 (refer to FIG. 2 of the abovementioned embodiment), it is possible to prevent assuredly the solder inside the channel from being hardened.

When the liquid to be transported in the liquid transporting apparatus is melted solder, for preventing more assuredly the solder from hardening inside the channel, as shown in an embodiment in FIG. 11, it is preferable that the heat generator 25 is provided on each of an inner surface of a common liquid chamber (corresponds to the common ink chamber 14 in the abovementioned embodiment), and on an inner surface of the plurality of individual channels 15 branching from the common liquid chamber.

Apart from this, the present invention is also applicable to an apparatus such as an apparatus which forms a wiring pattern by transferring an electroconductive liquid in which metallic nano particles are dispersed, an apparatus which manufactures a DNA chip by using a solution in which DNA is dispersed, an apparatus which manufactures a display panel by using a solution in which an electro luminescence material such as an organic compound is dispersed, and an apparatus which manufactures a color filter for a liquid crystal display by using a solution in which pigments for color filter are dispersed.

Moreover, the liquid to be used in the liquid transporting apparatus of the present invention is not restricted to a case in which the liquid is electroconductive is not restricted to an electroconductive liquid), and may be an electroconductive liquid similar to an electroconductive liquid made by dispersing an electroconductive additive to an insulating liquid.

What is claimed is:

1. A liquid transporting apparatus which transports an electroconductive liquid, comprising:

a channel forming body having a liquid channel through which the liquid flows formed therein;

a transporting electrode arranged on a surface, of the channel forming body, defining the liquid channel;

an insulating layer arranged on the surface of the channel forming body defining the liquid channel to cover the transporting electrode;

a power supply which applies a predetermined electric potential to the transporting electrode; and a temperature regulator which regulates a temperature of the liquid in the liquid channel at a predetermined temperature;

wherein the liquid channel has a common liquid chamber and a plurality of individual channels which are branched from the common liquid chamber;

wherein the transporting electrode has a plurality of individual transporting electrodes corresponding to the individual channels;

wherein the temperature regulator has a plurality of heating spots corresponding to the individual transporting electrodes;

wherein the temperature regulator includes a heater which heats the liquid in the liquid channel;

wherein the heater is a heat generator which releases heat by an electric current;

wherein the heat generator is formed on the surface of the liquid channel on which the transporting electrode is arranged; and wherein the insulating layer which covers the transporting electrode covers the heat generator.

2. The liquid transporting apparatus according to claim 1;

wherein each of the individual transporting electrodes is formed on a surface portion, of the channel forming body, defining one of the individual channels.

3. The liquid transporting apparatus according to claim 2;

wherein the heat generator is formed commonly for the plurality of individual channels.

4. The liquid transporting apparatus according to claim 2;

wherein the heat generator is formed on the surface portion of the channel forming body defining each of the individual channels, at a position on an upstream side, of one of the individual transporting electrodes, in a flow direction of the liquid.

5. The liquid transporting apparatus according to claim 4;

wherein the heat generator is formed on the surface portion of the channel forming body, defining each of the individual channels, at a position on a downstream side, of one of the individual transporting electrodes, in the flow direction.

6. The liquid transporting apparatus according to claim 4;

wherein the heat generator is arranged on the surface of the channel forming body defining the individual channel, on one side in a width direction orthogonal to the flow direction, and the insulating layer is not arranged on the surface of the channel forming body defining the individual channel, on the other side in the width direction.

7. The liquid transporting apparatus according to claim 2;

wherein the heat generator is formed on a surface of the channel forming body defining the common liquid chamber.

8. The liquid transporting apparatus according to claim 2;

wherein the electric current is supplied to the heat generator by the power supply, and the liquid in the liquid channel is heated by the heat generator.

9. The liquid transporting apparatus according to claim 8;

wherein a plurality of first contact portions connected to the individual transporting electrodes respectively, and a plurality of second contact portions connected to the heat generator are drawn up to an end portion of the channel forming body.

10. The liquid transporting apparatus according to claim 9;

wherein a plurality of liquid jetting ports communicating with the plurality of individual channels respectively is formed at one end portion of the channel forming body; and wherein the first contact portions and the second contact portions are drawn up to another end portion of the channel forming body, on a side opposite to the liquid jetting ports.

11. The liquid transporting apparatus according to 1;

wherein the temperature regulator includes a temperature detecting unit which detects the temperature of the liquid in the liquid channel, and a temperature control unit which controls the heater based on the temperature of the liquid detected by the temperature detecting unit.

12. The liquid transporting apparatus according to claim 11;

wherein the liquid in the liquid channel is a melted solder; and wherein the temperature control unit controls the heater such that a temperature of the solder is not less than a melting temperature of the solder.

13. The liquid transporting apparatus according to claim 1;

wherein each of the heating spots of the temperature regulator is arranged in one of the individual channels to be located adjacent to one of the individual electrodes and at an upstream of one of the individual channels.

* * * * *